US006336681B1

(12) United States Patent
Crosbie

(10) Patent No.: US 6,336,681 B1
(45) Date of Patent: Jan. 8, 2002

(54) CHAIR AND SEAT CUSHION THEREFOR

(76) Inventor: Robert Andrew Crosbie, PO Box 181 Drummoyne, New South Wales 2047 (AU)

( * ) Notice: Subject to any disclaimer, the term of this patent is extended or adjusted under 35 U.S.C. 154(b) by 0 days.

(21) Appl. No.: 09/407,902

(22) Filed: Sep. 29, 1999

(51) Int. Cl.[7] ..... A47C 7/18
(52) U.S. Cl. ..... 297/452.27; 297/452.21
(58) Field of Search ..... 297/452.21, 452.26, 297/452.27; 5/653

(56) References Cited

U.S. PATENT DOCUMENTS

| | | | | | |
|---|---|---|---|---|---|
| 3,751,111 | A | * | 8/1973 | Taylor et al. | 297/452.27 |
| 4,699,427 | A | * | 10/1987 | Kobayashi | 297/452.27 X |
| 4,726,086 | A | * | 2/1988 | McEvoy | 5/653 |
| 4,951,334 | A | * | 8/1990 | Maier | 297/452.27 X |
| 5,439,270 | A | * | 8/1995 | Owen | 5/653 X |
| 5,442,823 | A | * | 8/1995 | Siekman et al. | 297/452.27 X |

FOREIGN PATENT DOCUMENTS

| | | |
|---|---|---|
| AU | 59390/80 | 1/1981 |
| AU | 60004/86 | 1/1987 |
| AU | 68862/87 | 8/1987 |
| AU | 78937/87 | 3/1989 |
| AU | 78448/91 | 12/1991 |
| AU | 21724/92 | 1/1993 |
| AU | 33175/93 | 9/1993 |
| AU | 16468/97 | 10/1997 |
| EP | 0 764 412 | 3/1997 |
| WO | WO 95/06424 | 3/1995 |
| WO | WO 97/16999 | 5/1997 |

* cited by examiner

*Primary Examiner*—Peter R. Brown
(74) *Attorney, Agent, or Firm*—Browdy and Neimark

(57) ABSTRACT

A seat member and a chair having the seat member. The seat member includes a forward supporting cushion and an adjacent rear supporting cushion. The rear supporting cushion has a high resistance to resilient deformation and the forward supporting cushion has a low resistance to resilient deformation, the resistance to resilient deformation of each cushion being relative to the other cushion. The cushions can be formed of polyurethane foam and mounted on a base member. An intermediate foam layer can be disposed between the cushions and the base member. A top layer can also be incorporated into the seat member. The top layer can include a layer of polyurethane foam and/or a layer of gel material. A seat member including a layer of gel material, such as a hydrogel or viscoelastic polyurethane gel in a protective outer layer is also described.

27 Claims, 3 Drawing Sheets

CHAIR AND SEAT CUSHION THEREFOR

FIELD OF THE INVENTION

The present invention relates to a chair and in particular a seat cushion for a chair that allows a person occupying the chair to sit with good posture while also maximising blood circulation in the lower limbs.

BACKGROUND ART

The human body evolved for the purposes of running and walking and not prolonged sitting. Sitting originated as a function related to status and as such chairs were designed to reflect the status of the sitter. The combination of poor chair design with an increase in sedentary lifestyle has lead in modern times to an increase in spinal and other problems resulting from the body being seated for long periods of time.

It is known that the adoption of an upright seating posture can prevent and help alleviate some spinal conditions that lead to back pain. One type of chair that does encourage correct seating posture is those chairs having a seat portion that slopes forwardly. Such chairs can sometimes have a knee rest that helps prevent the person sitting in the chair from sliding forwardly off the seat member. One disadvantage of this known seat is that the pressure exerted on the knees by the knee rest can result in discomfort for the sitter.

An example of an alternative type of chair that is described as encouraging good seating posture is the chair described in Australian patent specification AU-B-73415/87. This chair has a seat member including at least forward and rear support portions separated by a crevice. The rear support portion is described as having a relatively low resistance to resilient deformation compared to that of the forward support cushion. The combination of this difference in relative resistance to resilient deformation of the forward and rear support portions and the crevice therebetween serves to locate the sitter's ischial tuberosities behind the forward support portion so that the forward portion can exert a rearwardly directed pressure on the ischial tuberosities. This in turn is described as resulting in the sitter being supported in an ergonomically correct posture. One perceived disadvantage with the seat member described in AU-B-73415/87 is that the relatively higher resistance to resilient deformation of the forward support cushion can exert a level of pressure on the back of the thighs that leads to at least some impedance of the peripheral blood circulation in this area with its attendant consequences. A further potential disadvantage is that depending on the sitter's anthropometrics, a sitter may have no choice but to sit in a position where their ischial tuberosities are not positioned behind the crevice thereby negating any perceived benefit that the chair might normally provide to the posture of a sitter.

SUMMARY OF THE INVENTION

According to a first aspect, the present invention consists in a seat member for a chair, the seat member including a forward supporting portion and an adjacent rear supporting portion, wherein the rear supporting portion has a high resistance to resilient deformation and the forward supporting portion has a low resistance to resilient deformation, the resistance to resilient deformation of each portion being relative to the other portion.

The seat member preferably includes a base member that supports the forward and rear supporting portions.

In one embodiment, the forward and rear supporting portions can comprise separate cushions supported by the base member.

In another embodiment, the forward and rear supporting portions can comprise separate cushions that are in abutment with each other.

In a still further embodiment, the forward and rear supporting portions can comprise cushions that are affixed to each other, such as by a suitable adhesive.

In yet a further embodiment, the forward and rear supporting portions can be integral.

In still yet a further embodiment, the forward and rear supporting portions are formed by the insertion of a partition into a cushion cover that allows the cushion cover to be divided into areas that when filled have respectively a lower and higher resistance to resilient deformation relative to each other.

The cushions in this embodiment preferably have a fabric cover. Covers made of other suitable materials, including vinyl and leather can be readily envisaged.

The forward supporting portion can in one embodiment occupy between 30 and 70% of the area defined by the seat member and the rear supporting portion between 70 and 30% of this area. In a preferred embodiment, each occupy about 50% of the area defined by the seat member. In other embodiments, the forward supporting portion can occupy more of the area of the seat member than the rear supporting portion and in another embodiment the inverse can be the case.

The forward and rear supporting portions can be formed from a foam material. For example, the foam material can comprise cut foam or molded foam. While other foams such as rubber latex foams can be utilised, the foam material is preferably a polyurethane foam. Flexible polyurethane foam is made up of a network of cellular shapes comprised of tiny struts and cell windows. The struts form the exterior support structure of the cells, while the windows are voids which are created as foam bubbles burst during the foam production process. Common struts are shared among cells to create a unified material with good structural integrity and handing strength. This structure complements the elasticity of the plastic material allowing polyurethane cells to compress and recover on response to applied load.

If required, the foam material can incorporate fillers or additives. For example, additives are sometimes incorporated to improve the combustion performance of the foams.

In a preferred embodiment, the rear supporting portion is formed from a foam material having a firmness greater than that of the foam material comprising the forward supporting portion. In one embodiment, the rear supporting portion can be formed from polyurethane foam having a measured Indentation Force Deflection (25% IFD) greater than that of the forward supporting portion. The rear supporting portion preferably has a 25%, IFD of between about 85 to 105 Newtons and the forward supporting portion a 25% IFD of between about 70 to 90 Newtons.

Further, the rear supporting portion can be formed from a foam material having a density substantially the same or greater than the density of the foam material comprising the forward supporting portion.

One particularly suitable polyurethane foam for use as the rear supporting portion is sold under the name Dunlop Enduro—EN36-130 by Dunlop Flexible Foams. This flexible foam has the following characteristics:

| | | | |
|---|---|---|---|
| Density: | 36–38 kg/m$^3$ | | |
| IFD: | 25% | 40% | 65% |
| Minimum | 85 | 110 | 205 |
| Maximum | 105 | 140 | 250 |
| Indentation Factor: | 2.39 | | |

A particularly suitable foam for use as the forward supporting portion is sold under the name Dunlop Enduro—EN36-100 by Dunlop Flexible Foams. This flexible foam has the following characteristics:

| | | | |
|---|---|---|---|
| Density: | 36–38 kg/m$^3$ | | |
| IFD: | 25% | 40% | 65% |
| Minimum | 70 | 95 | 170 |
| Maximum | 90 | 120 | 220 |
| Indentation Factor: | 2.44 | | |

Both the forward and rear supporting portions each have a forward edge, a rearward edge and side edges.

In another embodiment of the invention, the density of one or both of the forward and rear supporting portions can vary from the forward edge to the rearward edge. For example, the density of the portion might decrease from its rearward edge to its forward edge.

In a still further embodiment, the resistance to resilient deformation of one or both of the forward and rear supporting portions may vary from the forward edge to the rearward edge. For example, the resistance to resilient deformation of the portion might decrease from its rearward edge to its forward edge.

In a still further embodiment, the rear supporting portion may comprise at least two layers, one upper layer disposed above a lower layer. In this embodiment, the upper layer can have a low resistance to resilient deformation and the upper layer a high resistance to resilient deformation, the resistance to resilient deformation of each layer being relative to the other layer. In an alternative embodiment, the upper layer can have the same or a relatively higher resistance to resilient deformation compared to that of the lower layer. In one embodiment, the lower layer can be disposed adjacent the base member. While the upper and lower layers can have different resistances to resilient deformation, the overall combined resistance to resilient deformation of the upper and lower layers comprising the rear supporting portion in these embodiments is relatively higher than that of the forward supporting portion.

In a still further embodiment, the upper and lower layers can both vary in thickness from the forward edge to the rearward edge of the rear portion. In one embodiment, the thickness of the lower layer can constitute about 0% of the total thickness of the rear portion at or adjacent the forward edge and between about 5 and 90%, more preferably between 5 and 40%, and most preferably about 10%, of the total thickness of the rear portion at or adjacent its rearward edge. The variation in the proportion of the lower layer to the total thickness of the rear portion can increase linearly or non-linearly from the forward edge to the rearward edge. In another embodiment, the proportion can increase rapidly near the forward edge and then more slowly towards the rearward edge. Again, regardless of the variation in thickness of the lower layer, the overall resistance to resilient deformation of the rear supporting portion is relatively higher than that of the forward supporting portion.

The forward and rear supporting portions can comprise an integral part of the base member or be releasably attached or simply placed on the base member.

In another embodiment, an intermediate portion can separate the base member from the forward and rear supporting portions. The intermediate portion can comprise a foam layer. The intermediate foam layer can be a cut or molded polyurethane foam. The forward and rear supporting portions can be affixed to an upper surface of the intermediate layer or can be releasably attached or simply placed on the upper surface.

The intermediate foam layer can have a resistance to resilient deformation about equal to that of the rear supporting portion, or it can be greater or lesser than that of the rear portion. One suitable polyurethane foam is sold under the name Dunlop Enduro—EN38-200 flexible foam by Dunlop Flexible Foams. This flexible foam has the following characteristics:

| | | | |
|---|---|---|---|
| Density: | 38–41 kg/m$^3$ | | |
| IFD: | 25% | 40% | 65% |
| Minimum | 150 | 185 | 345 |
| Maxinium | 180 | 225 | 415 |
| Indentation Factor: | 2.30 | | |

In an alternative embodiment, the intermediate layer can comprise at least one layer of gel material, such as a hydrogel, contained within a suitable protective outer layer. The protective outer layer can comprise a polyurethane film material.

In a still further embodiment, a top layer can extend across the seat member above the forward and rear supporting portions. The top layer can comprise at least one layer of polyurethane foam as described above. In one embodiment, the top layer can be formed from the same polyurethane foam as the forward portion. The top layer can be molded integrally with the forward and/or rear supporting portions or can be adhered to or simply placed on the forward and/or rear supporting portions.

In another embodiment, the top layer can comprise at least one layer of gel material contained within a suitable protective outer layer. The gel material can comprise a hydrogel or a polymer gel. The polymer gel can comprise a viscoelastic polyurethane gel. One example of a suitable polyurethane gel is sold under the trade mark "ISOGEL" by Pittsburgh Plastics Manufacturing, Inc of Zelienople, Pa., United States of America. The protective outer layer can comprise a polyurethane film material.

It will be readily envisaged that additional layers, either above or below the layer of gel material, could be incorporated into the seat member.

The seat member can be enclosed within a suitable cover. The cover can be fabricated from a fabric material or other suitable material, such as vinyl or leather.

The forward support portion or the top layer can have a central upwardly extending mound that encourages greater ilio-psoas contraction in a sitter for an improved lumbar lordosis. The mound can be formed by an additional layer of foam material in the seat member.

A lower edge of the forward supporting portion can extend forwardly a distance greater than that of its upper edge. A forward edge surface extending between the forward upper and lower edges can be linear or curved in cross-section.

The regions of the forward and rear supporting portions adjacent the side edges can be of a thickness greater than that of the remainder of the portion. In another embodiment, the region of the top layer adjacent its side edges can be of a thickness greater than the remainder of the top layer.

The present seat member in including a forward and rear supporting portion supports the pelvis by minimising the possibility of the pelvis sliding forwardly and so leading the sitter to adopting a slumped seating posture. This in turn encourages correct spinal position, including lumbar and cervical lordosis, and correct breathing. The relatively lower resistance to resilient deformation of the forward supporting portion serves to also lower the pressure exerted by this portion on the backs of the thighs of the sitter compared to those chairs that in this section of the seat are fabricated from a material having a relatively higher resistance to deformation. This serves to minimise the discomfort normally caused by this pressure and also allows a higher level of peripheral blood circulation in the area of the body in contact with the seat member so preventing the occurrence of undesirable medical conditions, such as varicose veins.

The present seat member also serves to locate a sitter's ischial tuberosities in an ergonomically correct posture by allowing the sitter's ischial tuberosities to be supported by the rear supporting portion.

According to a further aspect, the present invention consists in a seat member for a chair, the seat member including at least one layer of gel material.

The gel material can be contained within a suitable protective outer layer. The gel material can comprise a hydrogel or a polymer gel. The polymer gel can comprise a viscoelastic polyurethane gel. One example of a suitable polyurethane gel is sold under the trade mark "ISOGEL" by Pittsburgh Plastics Manufacturing, Inc of Zelienople, Pa., United States of America. The protective layer can be formed of a elastomeric material, such as a polyurethane film material.

The seat member preferably includes a base member. The layer of gel material can be supported on the base member. The layer of gel material can be simply placed on the base member or affixed thereto.

In an embodiment of this further aspect, an intermediate portion can separate the base member from the layer of gel material. The intermediate portion can comprise at least one foam layer. The intermediate foam layer can be a cut or molded polyurethane foam as described above. The layer of gel material can be affixed to an upper surface of the intermediate layer or can be releasably attached or simply placed on the upper surface.

In a still further embodiment, a top layer can extend across the seat member above the layer of gel material. The top layer can comprise a layer of polyurethane foam as described above. The top layer can be adhered to or simply placed on the layer of gel material.

It will be readily envisaged that additional layers could be incorporated into the seat member of the further aspect, either above or below the layer of gel material.

The seat member according to the further aspect can be enclosed within a suitable cover. The cover can be fabricated from a fabric material or other suitable materials, such as vinyl or leather.

According to yet a further aspect, the present invention comprises a chair having the seat member as described in the above aspects or embodiments thereof.

The chair can comprise an office chair, a lounge chair or a chair used in automobiles, aeroplanes, ferries and other modes of transportation. The seat member can be oriented at an inclined angle relative to the surface supporting the chair or may be inclinable as desired by the sitter. The base member can be fabricated from a rigid material. Suitable materials include polymeric materials.

The chair will normally include at least one leg adapted to support the seat member. In one embodiment, the chair can have one leg that is adjustable to allow the height of the seat member to be adjusted relative to the surface on which the chair is placed. The one leg can be supported on a base comprising a plurality of outwardly extending legs. Each leg can have a castor that engages the surface on which the chair is placed.

The chair also preferably includes a back rest that extends at least upwardly adjacent the rearward edge of the rear supporting portion of the seat member. The back rest can be adjustable both upwardly and downwardly and forwardly and backwardly relative to the seat member. The backrest can include a support member and include at least one layer of foam material and/or gel material, such as is described above. The back rest preferably comprises a substantially flat surface with a lumbar mound extending outwardly therefrom that ensures an open chest and conservation of lumbar lordosis in a sitter.

The chair can further include arm rests. The arm rests can be adjustable up and down relative to the seat member and also releasably attachable if desired.

BRIEF DESCRIPTION OF THE DRAWINGS

By way of example only, preferred modes of the invention are now described with reference to the accompanying drawings, in which.

PREFERRED MODE OF CARRYING OUT OF THE INVENTION

Figure 1:
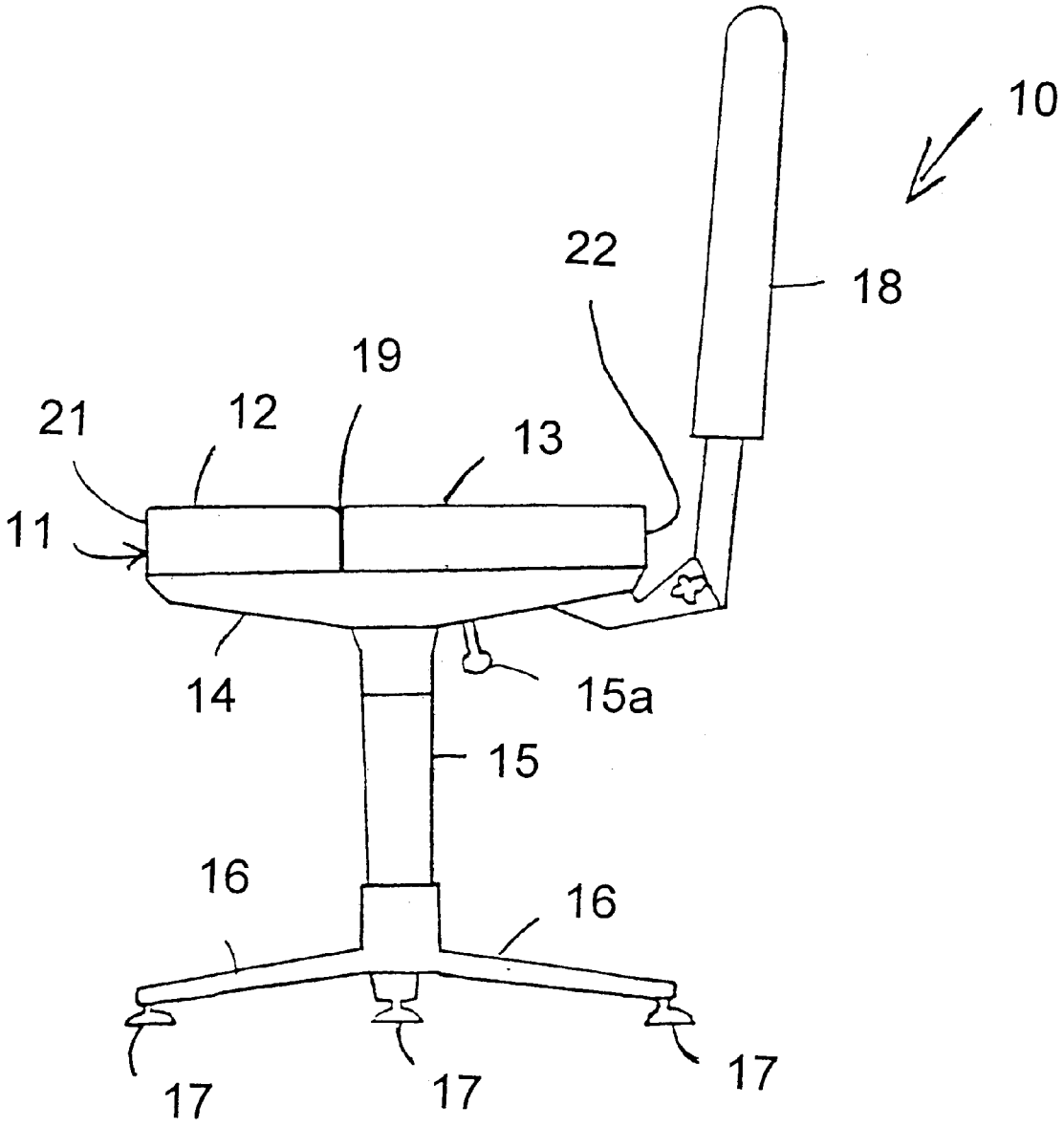
FIG. 1 is a side elevational view of a chair incorporating a seat member according to the present invention.

With reference to FIG. 1, a chair having a seat member according to the present invention is depicted generally as 10 in the drawing.

The chair 10 includes a seat member 11 comprising a first cushion 12, a second cushion 13 and a base member 14. The base member 14 is supported on a single upright leg 15, that can be adjusted by activation of lever 15*a*, to allow the height of the seat member 11 to be adjusted as desired by the user of the chair 10.

At the end of the leg 15 distal the seat member 11, the leg 15 has three outwardly extending leg members 16 each terminating with an endpiece 17 that engages the surface on which the chair is placed. It will be appreciated that the depicted endpieces 17 could be replaced by castors or other suitable surface engaging devices. It will also be readily understood that the chair 10 could instead of having one leg 15, could have a plurality of legs.

The chair 10 also has a back rest 18 that extends upwardly from adjacent the rearward end of the seat member 11. As with the leg 15, the back rest 18 can be adjustable, for example upwardly or downwardly and forwardly and backwardly relative to the seat member 11 as desired by a user. The backrest can in other embodiments be smaller than the back rest depicted or shaped differently as requirements dictate. For example, the back rest 18 can include a lumbar mound that ensures an open chest and conservation of lumbar lordosis in a sitter.

In the depicted embodiment, the cushions 12,13 have been formed separately and enclosed within separate covers before being mounted to the base member 14. On mounting, the forward edge of rear cushion 13 is abutted at 19 against the rearward edge of the forward cushion 12. Further, the length of the cushion 12 from its front edge 21 to the gap 19 constitutes just under about 40% of the length of the seat member 11 from the front edge 21 to the back edge 22.

Each of the cushions 12,13 comprise a fabric cover surrounding a polyurethane foam core. The polyurethane foam used in first cushion 12 has a lower resistance to resilient deformation than that of the foam used in second cushion 13. In the depicted embodiment, the foam of cushion 12 is Dunlop Enduro—EN36-100 and has a 25% IFD of about 80 and the foam of cushion 13 is Dunlop Enduro—EN36-130 and has a 25% IFD of about 95. The relative lower resistance to resilient deformation of first cushion 12 results in a lower level of pressure being exerted on the backs of the thighs of a sitter using the chair in a normal manner.

These polyurethane foams have similar densities, however, it can be envisaged that the cushion 12 could be formed from a foam having a density less than that of the cushion 13.

While not depicted, it can be readily envisaged that the seat member 11 could include a single cushion having a forward portion and rear portion formed by the placement of a partition extending the width of the cushion. The density of the polyurethane foam used in the forward portion of the cushion would be less than that placed in the rear portion. Other suitable fillings for the forward and rear cushions 12,13 or forward and rear portions of a single cushion can also be readily envisaged.

Figure 2:
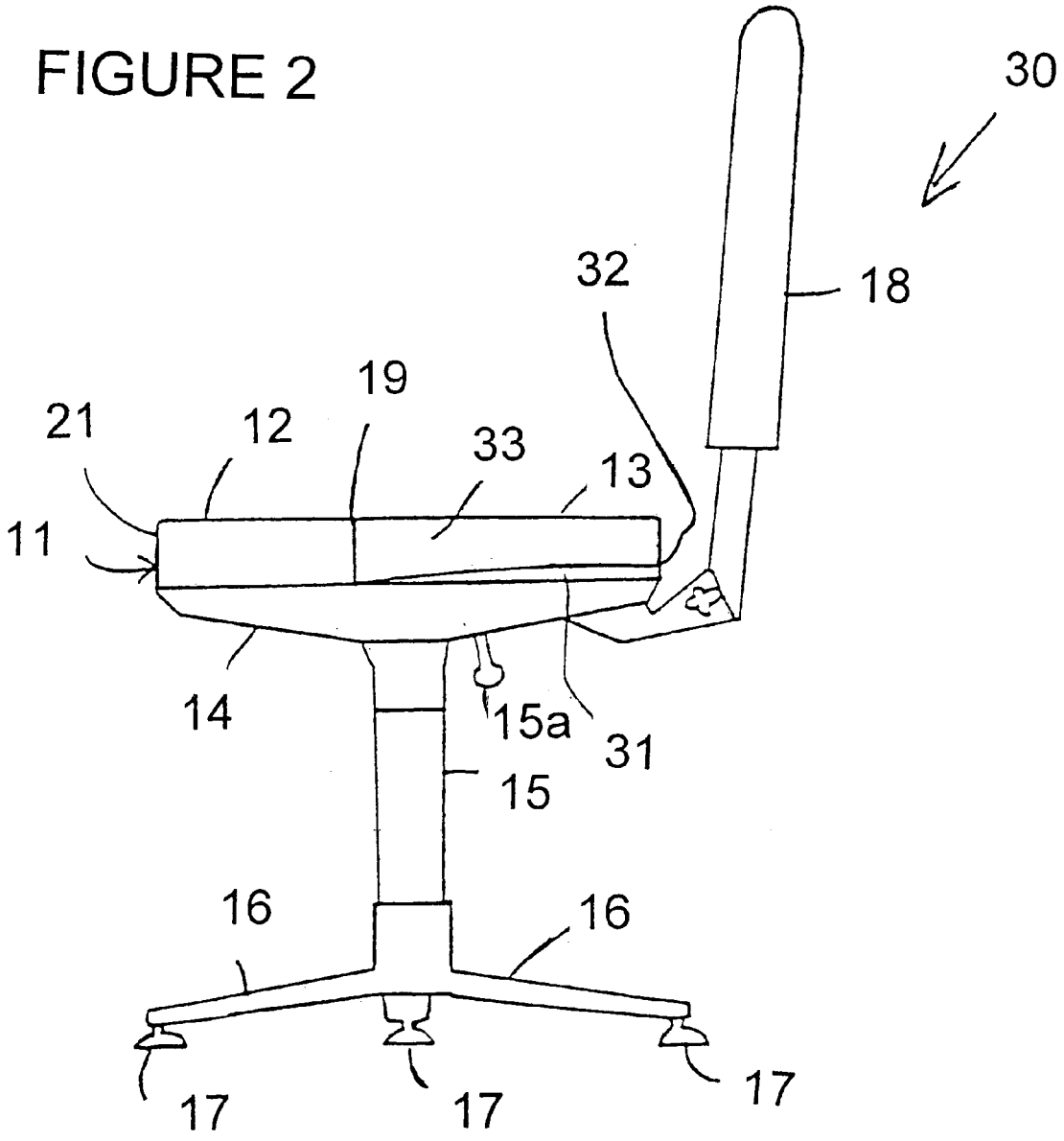
FIG. 2 is a side elevational view of another chair incorporating a second embodiment of a seat member according to the present invention.

With reference to FIG. 2, a second embodiment of a chair according to the present invention is depicted generally as 30 in the drawing. In describing this embodiment, features that are common to the example described in FIG. 1 have been like numbered.

In this example, the rear cushion 13 adjacent the back rest 18 is formed of two layers 33 and 31. Layer 33 overlays and is adhered to layer 31 and has a relatively low resistance to resilient deformation relative to the layer 31. Although the overall dimensions of the cushion 13 are similar to that of the chair depicted in FIG. 1, layer 33 is shaped such that adjacent join 19 it constitutes the full thickness of the cushion 13 whilst adjacent the rearward edge 32, it is less than about 20% the full thickness of the cushion 13. The layer 33 can be formed of Dunlop Enduro—EN36-100 foam and the lower layer 31 can be formed from Dunlop Enduro—EN36-130. In another embodiment, both layer 33 and layer 31 are of constant thickness from join 19 to the rearward edge 32. In this embodiment, the lower layer can constitute about 10% of the thickness of the cushion 13. While formed of layers, the overall resilience to resistant deformation of the rear cushion 13 is relatively higher than that of the forward cushion 12.

While the cushions 12,13 depicted in FIGS. 1 and 2 are depicted as having a rectangular vertical cross-section, it can be readily envisaged that the cushions 12,13 could be formed of other suitable shapes or contoured to provide a more suitable ergonomic posture for the user of the chair 10. For example, cushion 12 can be formed with a central upwardly extending mound that encourages greater iliopsoas contraction in a sitter for an improved lumbar lordosis. Each of the cushions 12,13 adjacent their side edges can also increase in thickness relative to the remainder of the cushion to provide a more comfortable and ergonomic seat for a sitter. The rear cushion 13 adjacent its rearward edge can also increase in thickness towards the edge to again provide a more comfortable seat for a sitter.

Figure 3A:
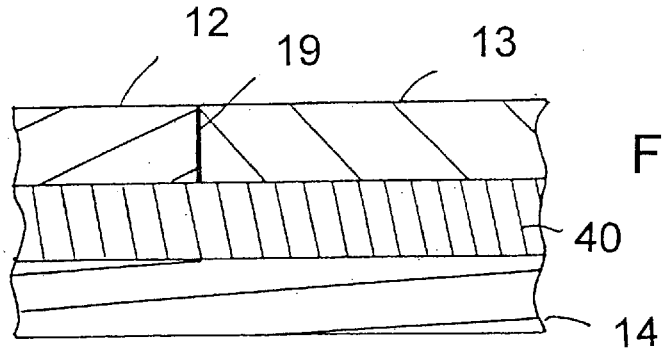
FIG. 3 provides simplified cross-sectional views of various seat members according to the present invention.

In the seat members depicted in FIGS. 1 and 2, an intermediate layer 40 can be inserted between the cushions 12,13 and the base member 14. An enlarged cross-sectional view of such an arrangement is depicted in FIGS. 3*a* and 3*c*. In this embodiment, the intermediate layer 40 is formed from a polyurethane foam layer. This layer 40 is formed from a polyurethane foam having a higher resistance to resilient deformation than the foam used in cushions 12,13. For example, the polyurethane foam can have a 25% IFD of about 165. The foam can also have a density greater than that of the foam in cushions 12,13. One example of the foam that can be used in the polyurethane layer is the Dunlop Enduro—EN38-200 flexible foam.

Figure 3B:
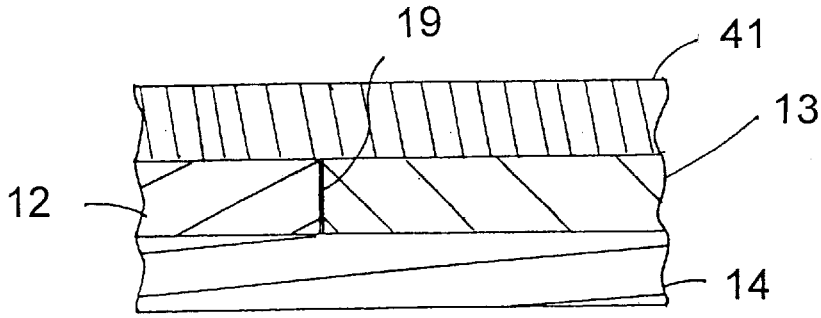
Figure 3C:
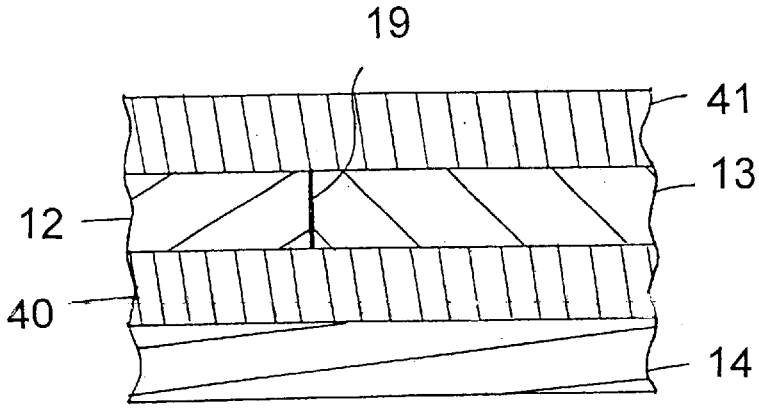

If desired, and as depicted in FIGS. 3*b* and 3*c*, a top layer 41 can also be positioned above cushions 12 and/or 13. The top layer 41 can include a layer of polyurethane foam, including one of the foams already used in cushions 12,13 or intermediate layer 40. The top layer 41 can also comprise or include a layer of gel material enclosed in a suitable protective cover. The gel material can be a hydrogel or a viscoelastic polyurethane gel enclosed within a polyurethane film encapsulant. If desired, such a layer of gel material can also be incorporated into the back rest 18 of the chairs 10,30.

Figure 3D:
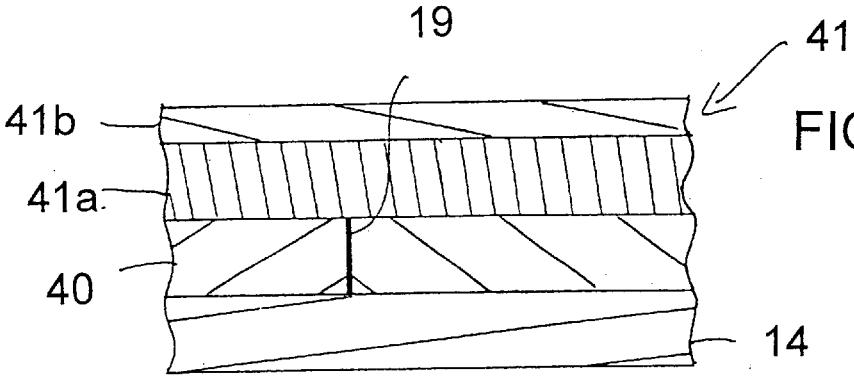

Another example of a seat member 11 according to the present invention is depicted in FIG. 3*d*. In this embodiment, the seat member includes a cushion 13 formed from Dunlop Enduro—EN38-200 and a cushion 12 formed of either Dunlop Enduro—EN36-100 or EN36-130. The top layer 41 is formed of a layer 41*a* of Dunlop Enduro—EN36-130 flexible foam and a still further layer of gel material 41*b*.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A seat member for a chair, the seat member including a forward supporting portion and an adjacent rear supporting portion, both the forward and rear supporting portions each having a forward edge, a rearward edge and side edges, the rear supporting portion having a high resistance to resilient deformation, the forward supporting portion having a low resistance to resilient deformation, the resistance to resilient deformation of each portion being relative to the other portion, the rear supporting portion including a first layer and at least a second layer of foam material, the first layer of foam material having a low resistance to resilient deformation and the second layer of foam material having a high resistance to resilient deformation, the resistance to resilient deformation of each layer in the rear supporting portion being relative to the other layer, wherein the resistance to resilient deformation of at least one of the forward and rear supporting portions varies from the rearward edge to the forward edge of the portion.

2. The seat member of claim 1 further including a base member that supports the forward and rear supporting portions.

3. The seat member of claim 2 wherein the forward and rear supporting portions comprise separate cushions supported by the base member.

4. The seat member of claim 2 wherein the forward and rear supporting portions are an integral part of the base member.

5. The seat member of claim 2 being engaged on the base member of a chair.

6. The seat member of claim 5, wherein the chair has a back rest that extends at least upwardly adjacent the rearward edge of the seat member.

7. The seat member of claim 5 wherein the back rest includes at least one layer of gel material.

8. The seat member of claim 2 wherein the forward and rear supporting portions are releasably attached to the base member.

9. The seat member of claim 2 wherein the forward and rear supporting portions rest on the base member.

10. The seat member of claim 1 wherein the forward and rear supporting portions comprise cushions that are in abutment with each other.

11. The seat member of claim 1 wherein the forward and rear supporting portions comprise cushions that are affixed to each other.

12. The seat member of claim 1 wherein the forward and rear supporting portions are integral.

13. The seat member of claim 1 wherein the forward supporting portion occupies between 30 and 70% of the area defined by the seat member and the rear supporting portion occupies between 70 and 30% of the area defined by the seat member.

14. The seat member of claim 13 wherein the forward supporting portion and rear supporting portion each occupy 50% of the area defined by the seat member.

15. The seat member of claim 1 wherein the forward and rear supporting portions are formed from a foam material.

16. The seat member of claim 15 wherein the first layer of foam material in the rear supporting portion is disposed above the second layer of foam material.

17. The seat member of claim 16 wherein the layers of foam material in the forward and rear supporting portions are formed from a polyurethane foam.

18. The seat member of claim 17 wherein the second layer of foam in the rear supporting portion is formed from polyurethane foam having a measured Indentation Force Deflection (25% IFD) greater than that of the first layer of foam material in the rear supporting portion and the foam material in the forward supporting portion.

19. The seat member of claim 18 wherein the second layer of foam material in the rear supporting portion has 25% IFD of between 85 to 105 Newtons and the first layer of foam material in the forward supporting portion a 25% IFD of between 70 to 90 Newtons.

20. The seat member of claim 16 wherein the second layer of foam material in the rear supporting portion is formed from a foam material having a density substantially the same or greater than the density of the foam material comprising the first layer of foam material in the rear supporting portion.

21. The seat member of claim 1 wherein the resistance to resilient deformation of the at least one of the forward and rear supporting portions decreases from a rearward edge to a forward edge.

22. The seat member of claim 16 wherein both the first and second layers of the rear supporting portion vary in thickness from the forward edge to the rearward edge of the rear supporting portion.

23. The seat member of claim 22 wherein the thickness of the second layer constitutes 0% of the total thickness of the rear portion at or adjacent the forward edge of the rear supporting portion and between about 5 and 90%, of the total thickness of the rear supporting portion at or adjacent its rearward edge.

24. The seat member of claim 23 wherein the variation in the proportion of the second layer to the total thickness of the rear supporting portion increases linearly from the forward edge to the rearward edge of that portion.

25. The seat member of claim 23 wherein the variation in the proportion of the second layer to the total thickness of the rear supporting portion increases rapidly near the forward edge and then more slowly towards the rearward edge of the rear supporting portion.

26. The seat member of claim 22 wherein the thickness of the second layer constitutes 0% of the total thickness of the rear portion at or adjacent the forward edge of the rear supporting portion and between about 5 and 40%, of the total thickness of the rear supporting portion at or adjacent its rearward edge.

27. The seat member of claim 22 wherein the thickness of the second layer constitutes 0% of the total thickness of the rear portion at or adjacent the forward edge of the rear supporting portion and between about 40%, of the total thickness of the rear supporting portion at or adjacent its rearward edge.

* * * * *